US009061296B2

(12) United States Patent
Peterson

(10) Patent No.: US 9,061,296 B2
(45) Date of Patent: Jun. 23, 2015

(54) MULTI PORT NOZZLE POINT INJECTION SYSTEM

(75) Inventor: John Peterson, Jackson, MN (US)

(73) Assignee: AGCO Corporation, Duluth, GA (US)

( * ) Notice: Subject to any disclaimer, the term of this patent is extended or adjusted under 35 U.S.C. 154(b) by 777 days.

(21) Appl. No.: 13/339,591

(22) Filed: Dec. 29, 2011

(65) Prior Publication Data

US 2012/0248227 A1 Oct. 4, 2012

Related U.S. Application Data

(60) Provisional application No. 61/427,823, filed on Dec. 29, 2010.

(51) Int. Cl.

| | |
|---|---|
| ***B05B 1/20*** | (2006.01) |
| ***B05B 1/34*** | (2006.01) |
| ***B05B 7/26*** | (2006.01) |
| ***B05B 7/28*** | (2006.01) |
| ***B05B 7/32*** | (2006.01) |
| ***B05B 1/14*** | (2006.01) |
| ***B05B 7/04*** | (2006.01) |
| ***B01F 5/04*** | (2006.01) |
| ***B01F 5/06*** | (2006.01) |
| ***B01F 13/10*** | (2006.01) |
| ***B05B 13/00*** | (2006.01) |
| ***B01F 3/08*** | (2006.01) |
| *B05B 12/00* | (2006.01) |

(52) U.S. Cl.

CPC ..... *B05B 1/14* (2013.01); *B05B 7/0408* (2013.01); *B01F 5/0473* (2013.01); *B01F 5/0619* (2013.01); *B01F 13/1022* (2013.01); *B05B 1/34* (2013.01); *B05B 12/002* (2013.01); *B05B 13/005* (2013.01); *B01F 3/0865* (2013.01)

(58) Field of Classification Search

CPC ..... B05B 1/14; B05B 1/34; B05B 7/0408; B05B 12/002; B05B 13/005; B01F 5/0473; B01F 5/0619; B01F 3/0865; B01F 13/1022

USPC ..... 239/142, 159, 172, 310, 312, 318, 398, 239/399, 403, 427, 432–434, 548–552, 589

See application file for complete search history.

(56) References Cited

U.S. PATENT DOCUMENTS

| | | | | |
|---|---|---|---|---|
| 2,964,248 | A | 12/1960 | O'Brien et al. | |
| 4,632,433 | A * | 12/1986 | Kimura | 285/38 |
| 5,076,497 | A | 12/1991 | Rabitsch | |
| 6,840,281 | B1 * | 1/2005 | Amidzich | 138/42 |
| 7,207,503 | B1 | 4/2007 | Stengel et al. | |
| 7,789,320 | B1 * | 9/2010 | Schwartz | 239/12 |
| 2009/0134237 | A1 | 5/2009 | Giles | |

OTHER PUBLICATIONS

International Search Report of PCT/US2011/067836 dated Mar. 26, 2012.

* cited by examiner

*Primary Examiner* — Darren W Gorman

(57) ABSTRACT

A multi port nozzle may be provided. The multi port nozzle may include a main inlet. In addition, the multi port nozzle may include a first chamber branching off from the main inlet. The first chamber may have a first port. Moreover, the multi port nozzle may include a second chamber branching off from the main inlet. The second chamber may be separated from the first chamber by a partition and may have a second port. The first chamber may include a first plurality of mixing elements and the second chamber may include a second plurality of mixing elements.

8 Claims, 4 Drawing Sheets

MULTI PORT NOZZLE POINT INJECTION SYSTEM

CROSS-REFERENCE TO RELATED APPLICATION

Under provisions of 35 U.S.C. §119(e), Applicant claims the benefit of U.S. Provisional Application No. 61/427,823 filed Dec. 29, 2010, which is incorporated herein by reference in its entirety.

BACKGROUND

A sprayer is a device used to spray a liquid. In agriculture, a sprayer is a piece of equipment that applies herbicides, pesticides, and fertilizers to agricultural crops. Sprayers range in size from man-portable units (typically backpacks with spray guns) to self-propelled units similar to tractors, with boom mounts of 60-151 feet in length.

SUMMARY

This Summary is provided to introduce a selection of concepts in a simplified form that are further described below in the Detailed Description. This Summary is not intended to identify key features or essential features of the claimed subject matter. Nor is this Summary intended to be used to limit the claimed subject matter's scope.

A multi port nozzle may be provided. The multi port nozzle may include a main inlet. In addition, the multi port nozzle may include a first chamber branching off from the main inlet. The first chamber may have a first port. Moreover, the multi port nozzle may include a second chamber branching off from the main inlet. The second chamber may be separated from the first chamber by a partition and may have a second port. The first chamber may include a first plurality of mixing elements and the second chamber may include a second plurality of mixing elements.

Both the foregoing general description and the following detailed description provide examples and are explanatory only. Accordingly, the foregoing general description and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present invention. In the drawings.

DETAILED DESCRIPTION

Figure 1:
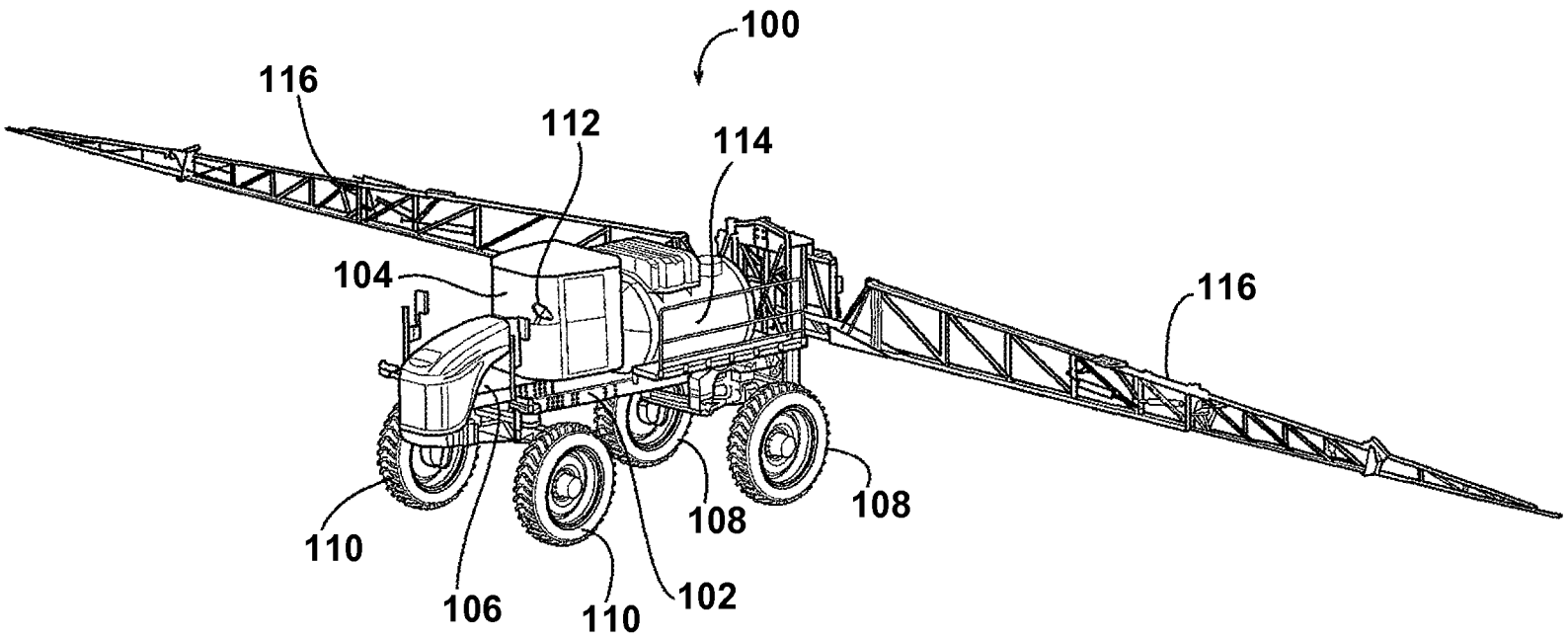
FIG. 1 shows a crop sprayer.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention.

A crop sprayer may spray (e.g. apply) herbicides, pesticides, and fertilizers on agricultural crops in a field. In many situations, it would be advantageous to spray more than one chemical on the agricultural crops in the field during one application. In order to do this with conventional systems, the different chemicals may need to be mixed together in the crop sprayer before the application. In some situations, however, the different chemicals may not be compatible. For example, it may be desired to spray different chemicals on agricultural crops in a field in one pass, however, mixing these different chemicals within a crop sprayer may cause undesired chemical relations between the different chemicals.

Consistent with embodiments of the invention, a multi port nozzle point injection system may be provided. With embodiments of the invention, it may be possible to spray more than one chemical on the agricultural crops in the field during one application without mixing the different chemicals in the crop sprayer. In other words, embodiments of the invention may dispense more than one chemical simultaneously and independently on the agricultural crops in the field during one application. In order to provide this, one or more multi port nozzles may be used by the crop sprayer in a multi port nozzle point injection system.

The multi port nozzle may have at least two chambers consistent with embodiments of the invention. During application, a carrier (e.g. a fluid) may be constant for all chambers. For example, the carrier may be injected into one main inlet that may branch off into the at least two chambers. Each of the at least two chambers may have its own injection point, mixing area, and dispense point. This may allow for more than one chemical to be dispensed simultaneously and independently while avoiding unwanted chemical deposits or reactions between incompatible chemicals. The additional benefit would be to minimize the need to flush the system between fields/jobs.

FIG. 1 shows a crop sprayer 100. Crop sprayer 100 may include a frame 102. Frame 102 may be of unitary construction or may include one or more pieces secured together. Frame 102 may comprise a support frame that may span crop sprayer 100's length and may provide a structure for mounting other crop sprayer 100's components. Crop sprayer 100 may also include a cab 104 mounted on frame 102. Cab 104 may houses an operator and a number of controls for crop sprayer 100.

An engine 106 may be mounted on a forward portion of frame 102 in front of cab 104 or may be mounted on a rearward portion of frame 102 behind cab 104. Engine 106 may be commercially available from a variety of sources and may comprise, for example, a diesel engine or may be a gasoline powered internal combustion engine. Engine 106 may be used to provide energy to propel crop sprayer 100 and may provide energy used to spray fluids from crop sprayer 100.

Frame 102 may be supported by a pair of rear wheels 108 and a pair of front wheels 110. Rear wheels 108 may be driven by engine 106 so as to propel crop sprayer 100. In particular, engine 106 may generate mechanical energy that may be transferred to rear wheels 108 by a transmission (not shown), drive shaft (not shown), and rear differential (not shown). Front wheels 110 may be operable to steer crop sprayer 100.

Crop sprayer 100's propulsion and direction may be controlled by one or more operator controls that include, but are not limited to, an accelerator (not shown), a brake (not shown), and a steering wheel 112. Alternatively, crop sprayer 100's propulsion may be integrated into a control handle (not shown). For example, the operator may push the control handle forward to increase crop sprayer 100's speed and may pull back the control handle to decrease crop sprayer 100's speed.

Crop sprayer 100 may further include a carrier tank 114 that may be used to store a fluid (e.g. the carrier) to be sprayed on a field. The fluid may comprise chemicals, such as but not limited to, water, herbicides, pesticides, or fertilizers. Carrier tank 114 may be mounted on frame 102, either in front of or behind cab 104. Crop sprayer 100 may include more than one tank to store different chemicals to be sprayed on the field.

Crop sprayer 100 may further include a boom arm 116 that may be operable to distribute the fluid over a wide swath in the field. As will be described in greater detail below, a plurality of nozzles may be spaced along boom arm 116 through which the fluid may be sprayed as crop sprayer 100 is driven forward in the field to distribute the chemicals onto crops in the field. Crop sprayer 100's operator may use the control handle, located in cab 104, to control boom arm 116's location and the fluid dispersion through the nozzles. The operator may use the control handle to turn on the fluid flow to the plurality of nozzles and to shut off the fluid flow to the plurality of nozzles.

Figure 2:
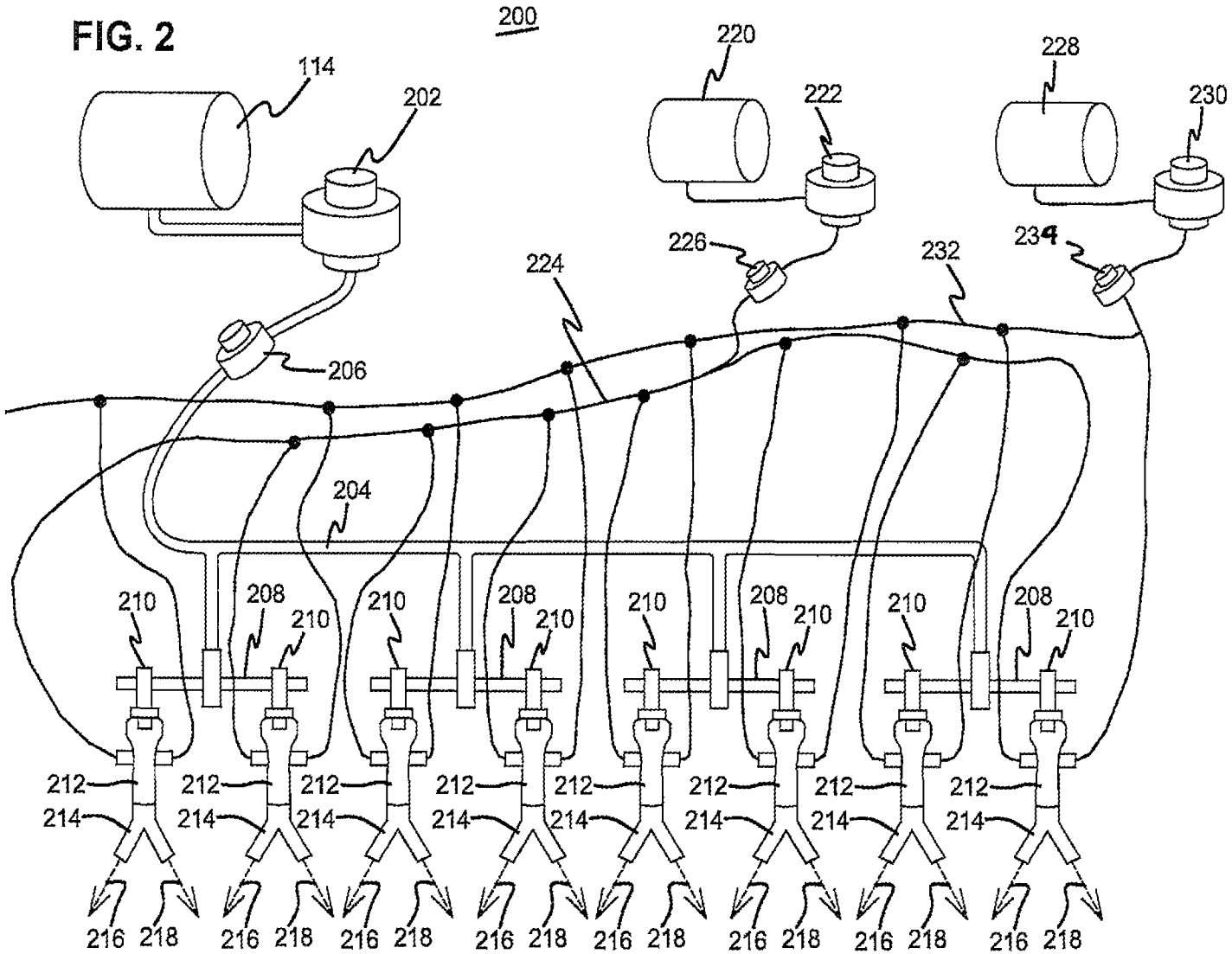
FIG. 2 shows a fluid delivery system.

FIG. 2 shows a multi port nozzle point injection system 200. As shown in FIG. 2, a carrier pump 202, which may be mounted on frame 102, may pump the carrier from carrier tank 114 into carrier hose 204. (Carrier pump 202 may also be mounted inside carrier tank 114 and submersed in carrier tank 114's fluid.) A carrier valve 206 may be used to control the carrier's flow in carrier hose 204. Carrier pump 202 and carrier valve 206 may be controlled by crop sprayer 100's operator located in cab 104. From carrier hose 204, the carrier may flow into a plurality of pipes 208. A plurality of nozzle bodies 210 may be mounted to each pipe 208. From each pipe 208, the carrier may flow from pipe 208 to each nozzle body 210.

Figure 3:
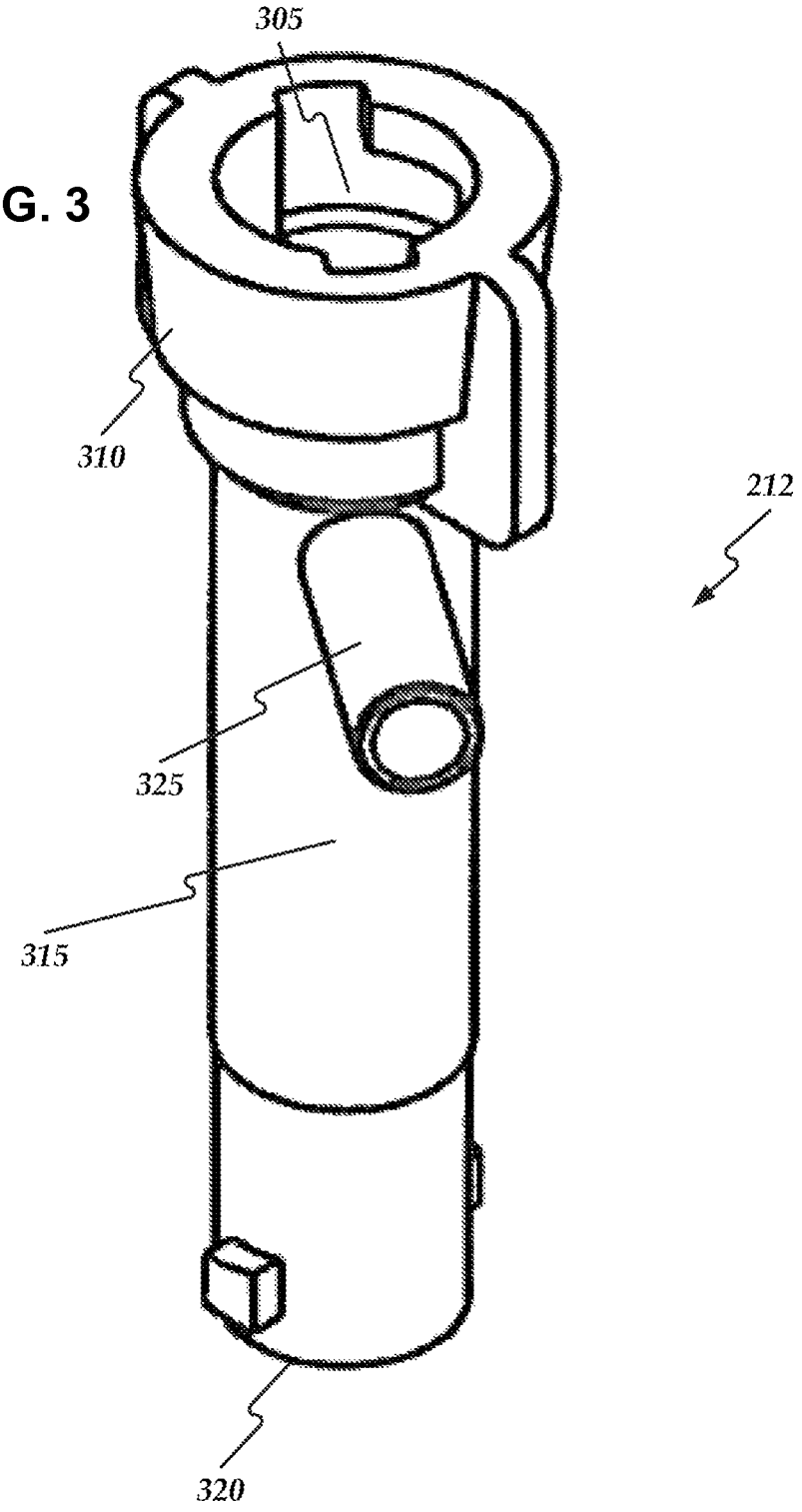
FIG. 3 shows a multi port nozzle.

A multi port nozzle 212 may be connected to each nozzle body 210. As shown in FIG. 3, multi port nozzle 212 may include a main inlet 305, a wing nut 310, a body 315, and an outlet end 320. Multi port nozzle 212 may be connected to nozzle body 210 via a connecting element, for example, wing nut 310. Body 315 may include a first port 325 and a second port 330 as shown in FIG. 4A. An outlet 214 may be connected to each outlet end 320 as shown in FIG. 2. During operation of multi port nozzle point injection system 200, a first flow 216 and a second flow 218 may exit each outlet 214 and be sprayed on agricultural crops in a field. First flow 216 and second flow 218 will be described in greater detail below.

Multi port nozzle point injection system 200 may also include a first chemical tank 220 that may be mounted on frame 102. A first chemical pump 222, which may also be mounted on frame 102, may pump a first chemical from first chemical tank 220 into a first chemical tank hose 224. (First chemical pump 222 may also be mounted inside first chemical tank 220 and submersed in first chemical tank 220's fluid.) The first chemical may be a fluid and may comprise, but not limited to, water, herbicides, pesticides, or fertilizers. A first chemical valve 226 may be used to control the first chemical's flow in hose 224. First chemical pump 222 and first chemical valve 226 may be controlled by crop sprayer 100's operator located in cab 104. From first chemical hose 224, the first chemical may flow into first port 325 on each multi port nozzle 212. As will be described in greater detail below, the first chemical may mix with the carrier inside each multi port nozzle 212 where the first chemical and carrier mix may exit as first flow 216.

Furthermore, multi port nozzle point injection system 200 may also include a second chemical tank 228 that may be mounted on frame 102. A second chemical pump 230, which may also be mounted on frame 102, may pump a second chemical from second chemical tank 228 into a second chemical tank hose 232. (Second chemical pump 230 may also be mounted inside second chemical tank 228 and submersed in second chemical tank 228's fluid.) The second chemical may be a fluid and may comprise, but not limited to, water, herbicides, pesticides, or fertilizers. A second chemical valve 234 may be used to control the second chemical's flow in hose 232. Second chemical pump 230 and second chemical valve 234 may be controlled by crop sprayer 100's operator located in cab 104. From second chemical hose 232, the second chemical may flow into second port 330 on each multi port nozzle 212. As will be described in greater detail below, the second chemical may mix with the carrier inside each multi port nozzle 212 where the second chemical and carrier mix may exit as second flow 218.

Figure 4B:
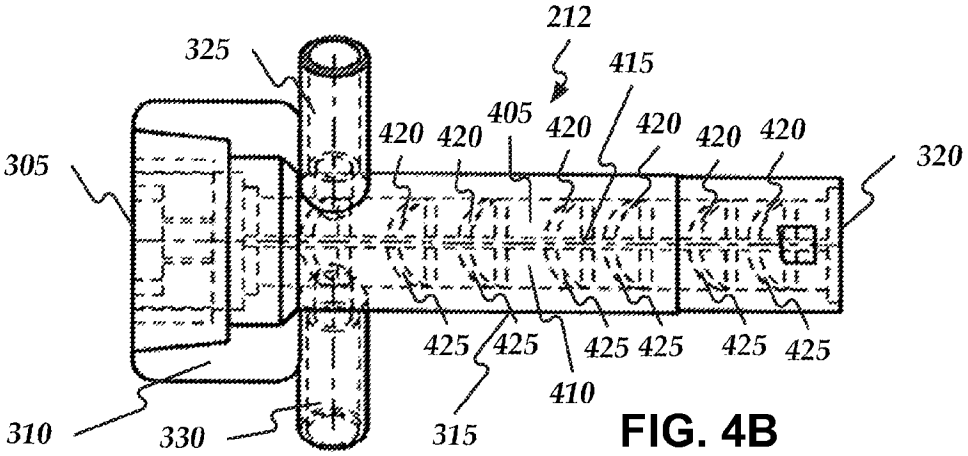
FIG. 4A through 4C show a multi port nozzle.
Figure 4C:
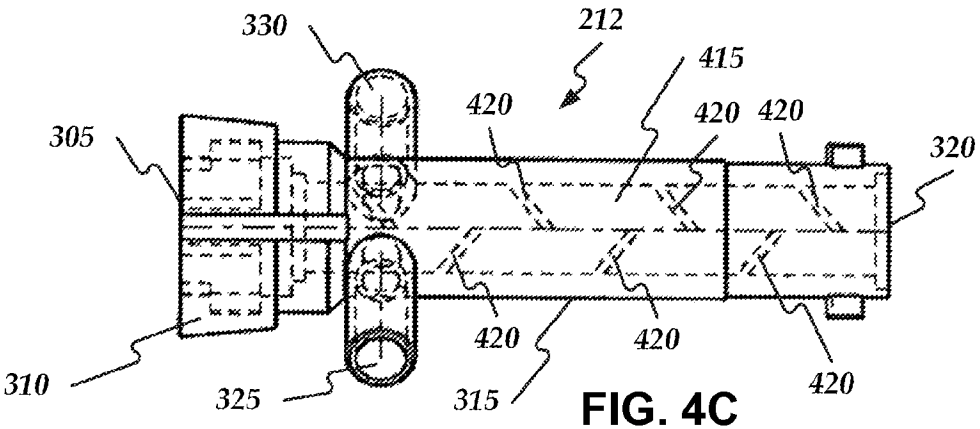
Figure 4A:
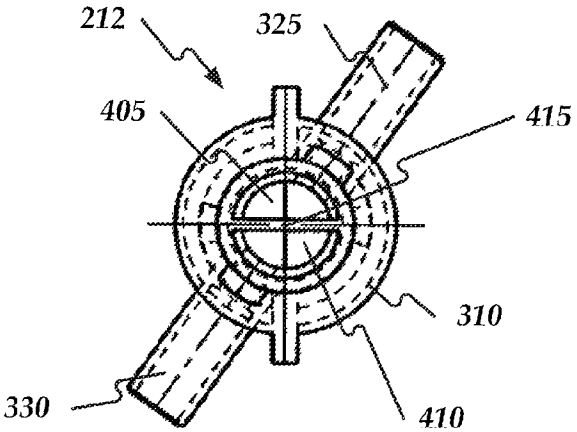

FIG. 4A, FIG. 4B, and FIG. 4C shown multi port nozzle 212 in more detail. As shown in FIG. 4A, an interior of body 315 may include a first chamber 405 and a second chamber 410 separated by a partition 415. As shown in FIG. 4B, first chamber 405 may have a first plurality of mixing elements 420. Similarly, second chamber 410 may have a second plurality of mixing elements 425. While multi port nozzle 212 is shown with two chambers, embodiments of the invention may include any number of chambers with any number of mixing elements.

Consistent with embodiments of the invention, during application, the carrier (e.g. a fluid) may flow into first chamber 405 and second chamber 410. For example, the carrier may be injected into main inlet 305 that may branch off into first chamber 405 and second chamber 410. The first chemical may enter first chamber 405 through first port 325. The second chemical may enter second chamber 410 through second port 330. Because the carrier is being injected under pressure from main inlet 305 toward outlet end 320, partition 415 causes the first chemical and the second chemical to remain separate in multi port nozzle 212. In other words, partition 415 causes the mixture of the first chemical with the carrier and the mixture of the second chemical with the carrier to remain separate and not come into contact in multi port nozzle 212. Consequently, embodiments of the invention may allow for more than one chemical to be dispensed simultaneously and independently while avoiding unwanted chemical deposits or reactions in the crop sprayer 100 between the first chemical and the second chemical.

As shown in FIG. 4B and in FIG. 4C, first chamber 405 may have first plurality of mixing elements 420. As the carrier is being injected under pressure from main inlet 305 toward outlet end 320, first plurality of mixing elements 420 tend to create turbulence in order to better mix the carrier and the first chemical in first chamber 405. First plurality of mixing elements 420, for example, may be placed at an angle in first chamber 405 and may comprise any geometry.

Moreover, as shown in FIG. 4B, second chamber 410 may have second plurality of mixing elements 425. As the carrier is being injected under pressure from main inlet 305 toward outlet end 320, second plurality of mixing elements 425 tend to create turbulence in order to better mix the carrier and the second chemical in second chamber 410. Second plurality of mixing elements 425, for example, may be placed at an angle in second chamber 410 and may comprise any geometry.

Consistent with embodiments of the invention, first chamber 405 may comprise a first injection point, a first mixing area, and a first dispense point. The first injection point may comprise the end of first chamber 405 that connects to main inlet 305. The first dispense point may comprise the end of first chamber 405 that connects to outlet end 320. The first mixing area may comprise the portion of first chamber 405 between the first injection point and the first dispense point. The first mixing area may include the first plurality of mixing elements 420.

Similarly, second chamber 410 may comprise a second injection point, a second mixing area, and a second dispense point. The second injection point may comprise the end of second chamber 410 that connects to main inlet 305. The second dispense point may comprise the end of second chamber 410 that connects to outlet end 320. The second mixing area may comprise the portion of second chamber 410 between the second injection point and the second dispense point. The second mixing area may include the second plurality of mixing elements 425.

While certain embodiments of the invention have been described, other embodiments may exist. Further, any disclosed methods' stages may be modified in any manner, including by reordering stages and/or inserting or deleting stages, without departing from the invention. While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as example for embodiments of the invention.

What is claimed is:

1. A multi port nozzle for use in a crop spraying system having a carrier tank supplying a carrier fluid, a first chemical tank supplying a first chemical fluid and a second chemical tank supplying a second chemical fluid, the multi port nozzle comprising:

a main inlet configured to receive a carrier fluid;

a first chamber branching off from the main inlet and receiving a first portion of the carrier fluid, the first chamber having a first port configured to receive a first chemical fluid, wherein the first chamber further comprises a first plurality of mixing elements to mix the first chemical fluid with the first portion of the carrier fluid;

a second chamber branching off from the main inlet and being separated from the first chamber by a partition and receiving a second portion of the carrier fluid, the second chamber having a second port configured to receive a second chemical fluid, wherein the second chamber further comprises a second plurality of mixing elements to mix the second chemical fluid with the second portion of the carrier fluid; and an outlet connected to an outlet end of the multi port nozzle, wherein the outlet is configured to direct a first flow from the first chamber and to direct a second flow from the second chamber.

2. The multi port nozzle of claim 1, wherein the first chamber and the second chamber are parallel.

3. The multi port nozzle of claim 1, wherein a cross-section of the first chamber is arc-shaped.

4. The multi port nozzle of claim 1, wherein a cross-section of the second chamber is arc-shaped.

5. The multi port nozzle of claim 1, wherein a cross-section of the first chamber is half-circle-shaped.

6. The multi port nozzle of claim 1, wherein a cross-section of the second chamber is half-circle-shaped.

7. The multi port nozzle of claim 1, further comprising a connecting element configured to connect the main inlet to a nozzle body.

8. The multi port nozzle of claim 7, wherein the connecting element comprises a wing nut.

* * * * *